US007425517B2

(12) United States Patent
Deka et al.

(10) Patent No.: US 7,425,517 B2
(45) Date of Patent: Sep. 16, 2008

(54) NONWOVEN FABRIC WITH ABRASION RESISTANCE AND REDUCED SURFACE FUZZINESS

(75) Inventors: Ganesh Chandra Deka, Duluth, GA (US); Christopher John Lawler, Appleton, WI (US); Billy Dean Arnold, Alpharetta, GA (US); David Joseph Reader, Appleton, WI (US); Ronald C. Cox, Smyrna, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 855 days.

(21) Appl. No.: 10/627,558

(22) Filed: Jul. 25, 2003

(65) Prior Publication Data

US 2005/0020170 A1 Jan. 27, 2005

(51) Int. Cl.
*D04H 1/00* (2006.01)

(52) U.S. Cl. ..... 442/327; 442/381; 442/382; 442/392

(58) Field of Classification Search ..... 442/327, 442/381, 382, 392
See application file for complete search history.

(56) References Cited

U.S. PATENT DOCUMENTS

| | | | | |
|---|---|---|---|---|
| 3,338,992 | A | 8/1967 | Kinney | |
| 3,341,394 | A | 9/1967 | Kinney | |
| 3,423,266 | A | 1/1969 | Davies et al. | |
| 3,502,763 | A | 3/1970 | Hartman | |
| 3,542,615 | A | 11/1970 | Dobo et al. | |
| 3,692,618 | A | 9/1972 | Dorshner et al. | |
| 3,802,817 | A | 4/1974 | Matsuki et al. | |
| 3,836,416 | A | 9/1974 | Ropiequet | |
| 3,855,046 | A | 12/1974 | Hansen et al. | |
| 3,933,557 | A | 1/1976 | Pall | |
| D239,566 | S | 4/1976 | Vogt | |
| 3,949,130 | A | 4/1976 | Sabee et al. | |
| 4,012,249 | A | 3/1977 | Stapp | |
| 4,032,688 | A | 6/1977 | Pall | |
| 4,100,324 | A | 7/1978 | Anderson et al. | |
| 4,107,364 | A | 8/1978 | Sisson | |
| 4,209,563 | A | 6/1980 | Sisson | |
| D264,512 | S | 5/1982 | Rogers | |
| 4,340,563 | A | 7/1982 | Appel et al. | |
| 4,374,888 | A | 2/1983 | Bornslaeger | |
| 4,429,001 | A | 1/1984 | Koplin et al. | |
| 4,493,868 | A | 1/1985 | Meitner | |
| 4,652,487 | A | 3/1987 | Morman | |
| 4,668,566 | A | 5/1987 | Braun | |
| 4,714,647 | A | 12/1987 | Shipp, Jr. et al. | |
| 4,731,215 | A | 3/1988 | Schwarz | |
| 4,778,460 | A | 10/1988 | Braun et al. | |
| 4,787,699 | A | 11/1988 | Moulin | |
| 4,818,464 | A | 4/1989 | Lau | |
| 5,108,820 | A | 4/1992 | Kaneko et al. | |
| 5,108,827 | A | 4/1992 | Gessner | |
| 5,294,482 | A | 3/1994 | Gessner | |
| 5,336,552 | A | 8/1994 | Strack et al. | |
| 5,350,624 | A | 9/1994 | Georger et al. | |
| 5,382,400 | A | 1/1995 | Pike et al. | |
| 5,509,915 | A | 4/1996 | Hanson et al. | |
| 5,591,335 | A | 1/1997 | Barboza et al. | |
| 5,605,749 | A * | 2/1997 | Pike et al. | 442/60 |
| 5,660,910 | A | 8/1997 | Hoyt et al. | |
| 5,679,042 | A | 10/1997 | Varona | |
| 5,681,469 | A | 10/1997 | Barboza et al. | |
| 5,707,468 | A | 1/1998 | Arnold et al. | |
| 5,720,832 | A | 2/1998 | Minto et al. | |
| 5,733,581 | A | 3/1998 | Barboza et al. | |
| 5,759,926 | A | 6/1998 | Pike et al. | |
| 5,820,645 | A | 10/1998 | Murphy, Jr. | |
| 5,858,515 | A | 1/1999 | Stokes et al. | |
| 6,074,869 | A | 6/2000 | Pall et al. | |
| 6,169,045 | B1 | 1/2001 | Pike et al. | |
| 6,200,669 | B1 | 3/2001 | Marmon et al. | |
| 6,342,283 | B1 | 1/2002 | Mozelack et al. | |
| 6,585,855 | B2 | 7/2003 | Drew et al. | |

FOREIGN PATENT DOCUMENTS

| | | |
|---|---|---|
| WO | WO 01/12889 | 2/2001 |
| WO | WO 02/18693 | 3/2002 |

OTHER PUBLICATIONS

Floyd, D.E., "Polyamide Resins", Second Edition, Library of Congress Control No. 66-020811, Reinhold Publishing, N.Y., 1966, Chapters 4 and 6, pp. 55-64; 92-131.

* cited by examiner

*Primary Examiner*—Elizabeth M. Cole
*Assistant Examiner*—Jennifer Steele
(74) *Attorney, Agent, or Firm*—Ralph H. Dean

(57) ABSTRACT

The present invention provides a nonwoven web or laminate having at least one surface with abrasion resistance and a low degree of free fibers on the surface. Also provided is a lofty nonwoven web laminate from multicomponent fibers having at least one surface with improved abrasion resistance and reduced fuzziness over other multicomponent fiber nonwoven webs. This nonwoven webs and laminate can be used where nonwoven webs and laminates are currently used, but are particularly suitable as a filter media. Also described is a method for producing a nonwoven web having at least one abrasion resistant surface. The process includes using a liner material between the forming surface and the forming nonwoven web, wherein the liner is removed after the nonwoven web is bonded. Removing the liner exposes the abrasion resistant surface of the nonwoven web or laminate.

26 Claims, 5 Drawing Sheets

NONWOVEN FABRIC WITH ABRASION RESISTANCE AND REDUCED SURFACE FUZZINESS

FIELD OF THE INVENTION

The present invention relates to a nonwoven web or nonwoven web laminate having an abrasion resistant surface, which is rough and has a reduced surface fuzziness. The present invention also relates to a method of making the nonwoven web.

BACKGROUND OF THE INVENTION

Nonwoven webs are generally formed on forming surfaces. Typical forming surfaces include forming wires and forming drums. Forming wires are generally a woven mesh material. The woven mesh material can be made from polymeric materials or can be made from metals. Typically, the side of the nonwoven web which is formed adjacent the forming wire will have some of the surface characteristics of the forming wire with respect to topography.

Nonwoven fabrics or webs are useful for a wide variety of applications such as diapers, feminine hygiene products, towels, recreational or protective fabrics and as geotextiles. The nonwoven webs used in these applications may be simply a fabric of a single type of material, such as spunbond nonwoven web, but are often in the form of nonwoven fabric laminates such as, for example, spunbond/spunbond laminates or spunbond/meltblown/spunbond (SMS) laminates. Laminates with other materials are also possible, such as with films, woven or knitted fabrics and paper.

In many of these applications, it is necessary for the surface of the nonwoven web or nonwoven web laminate to be abrasion resistant. Likewise, it is also necessary for the user of these products to perceive that the nonwoven web or nonwoven web laminate is durable and has a surface with a very low degree of fiber fuzziness.

Nonwoven webs and nonwoven web laminates have also been used as filter media. When used as a filter media, the nonwoven web not only must provide a high filter efficiency, i.e., prevent fine particles from passing through, but also needs to provide a high throughput, i.e., maintain the pressure drop across the filter medium as low as possible over the useful life. In addition, the useful service life of a filter medium must not be too short as to require frequent cleaning or replacement. However, these performance requirements tend to be inversely correlated. For example, a high efficiency filter medium tends to create a high pressure drop, severely restricting its throughput capability and service life. In addition to these properties, in many applications, filtration materials are required to have structural integrity by themselves. Further, filtration materials need to have properties so that the material can be converted into various shapes and which will then hold that shape.

There is a need in the art for an abrasion resistant nonwoven web or laminate which has reduced surface fuzziness. In addition, it is also desirable to have a filter media having these properties.

SUMMARY OF THE INVENTION

The present invention provides a nonwoven web having at least one surface with abrasion resistance, a surface roughness of at least 20 μm, and a fuzz-on-edge less than 1.0 mm/mm. The abrasion resistant surface of the nonwoven web exhibits very little, if any, roping or fuzzing, when abraided.

In addition, the present invention also provides a nonwoven web laminate having at least one surface with abrasion resistance, a surface roughness of at least 20 μm, and a fuzz-on-edge less than 1.0 mm/mm. The abrasion resistant surface of the nonwoven web exhibits very little, if any, roping or fuzzing, when abraided.

The present invention also provides a lofty nonwoven web from multicomponent fibers having at least one surface with improved abrasion resistance and fuzziness compared with other multicomponent fiber nonwoven webs. This nonwoven web has a surface roughness of at least 20 μm, and a fuzz-on-edge less than 1.0 mm/mm. This lofty nonwoven web is particularly useful as a filter media. The abrasion resistant surface of the nonwoven web exhibits very little, if any, roping or fuzzing, when abraided.

The present invention provides a method for producing a nonwoven web having at least one abrasion resistant surface, which has a surface roughness of at least 20 μm, and a fuzz-on-edge less than 1.0 mm/mm. In the process of the present invention, a liner material is supplied onto a nonwoven web forming surface. Next, a nonwoven web is formed on the liner material, and the nonwoven web is bonded. Finally, the liner material is removed from the formed nonwoven web and the resulting nonwoven web has improved abrasion resistance on the surface formed next to the removed liner. The formed nonwoven web can be a spunbond nonwoven web, a meltblown nonwoven web, a coform nonwoven web, a carded nonwoven web, or an air-laid nonwoven web.

DEFINITIONS

Figure 1:
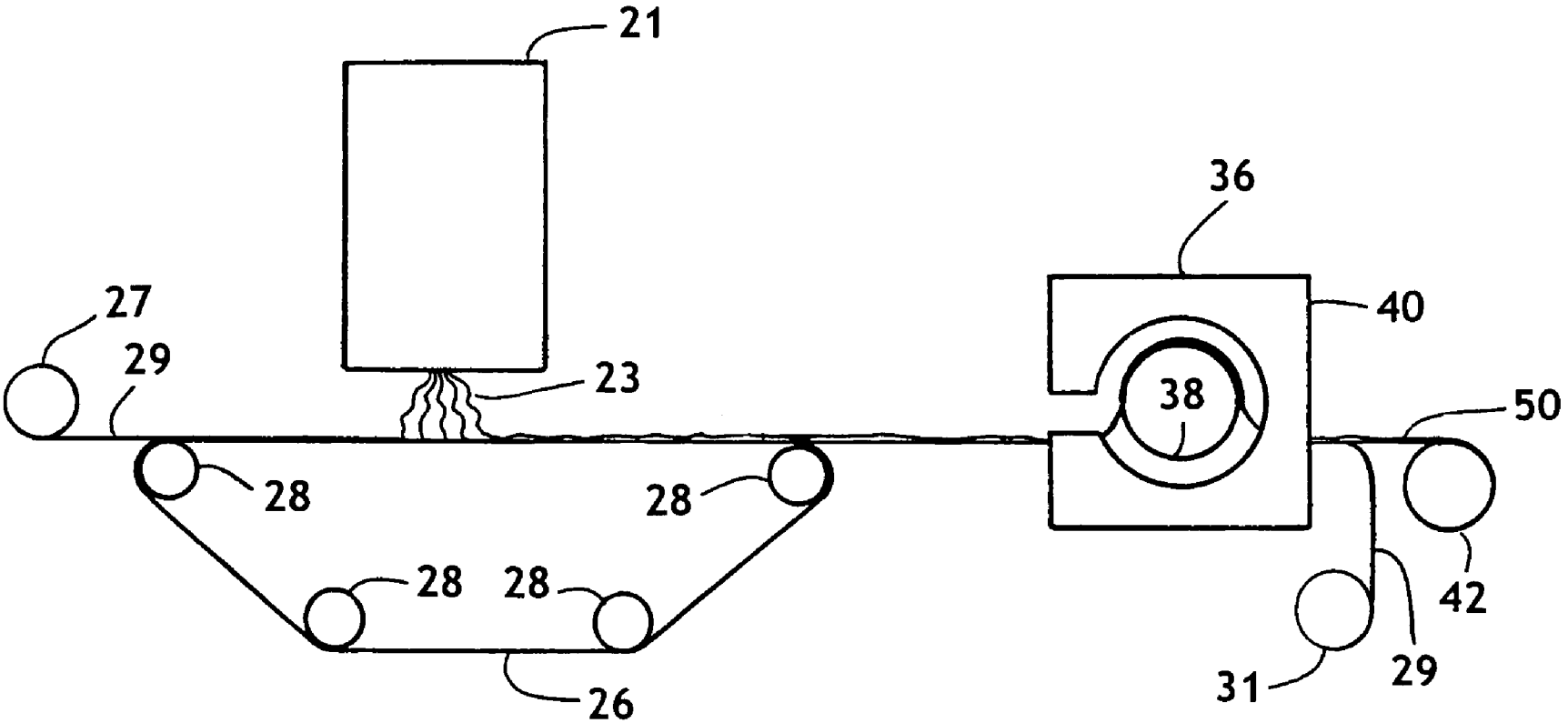
FIG. 1 shows an exemplary process schematic of the method of the present invention.

As used herein, the term "comprising" is inclusive or open-ended and does not exclude additional unrecited elements, compositional components, or method steps.

As used herein, the term "fiber" includes both staple fibers, i.e., fibers which have a defined length between about 19 mm and about 60 mm, fibers longer than staple fiber but are not continuous, and continuous fibers, which are sometimes called "substantially continuous filaments" or simply "filaments". The method in which the fiber is prepared will determine if the fiber is a staple fiber or a continuous filament.

As used herein, the term "nonwoven web" means a web having a structure of individual fibers or threads which are interlaid, but not in an identifiable manner as in a knitted web. Nonwoven webs have been formed from many processes, such as, for example, meltblowing processes, spunbonding processes, air-laying processes, coforming processes and bonded carded web processes. The basis weight of nonwoven webs is usually expressed in ounces of material per square yard (osy) or grams per square meter (gsm) and the fiber diameters useful are usually expressed in microns, or in the case of staple fibers or continuous filaments, denier. It is noted that to convert from osy to gsm, multiply osy by 33.91.

As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, which is hereby incorporated by reference in its entirety. Meltblown fibers are commonly microfibers, which may be continuous or discontinuous, and are frequently smaller than 10 microns in average diameter The term "meltblown" is also intended to cover other processes in which a high velocity gas, (usually air) is used to aid in the formation of the filaments, such as melt spraying or centrifugal spinning.

As used herein, the term "coform nonwoven web" or "coform material" means composite materials comprising a mixture or stabilized matrix of thermoplastic filaments and at least one additional material, usually called the "second material" or the "secondary material". As an example, coform materials may be made by a process in which at least one meltblown die head is arranged near a chute through which the second material is added to the web while it is forming. The second material may be, for example, an absorbent material such as fibrous organic materials such as woody and non-wood pulp such as cotton, rayon, recycled paper, pulp fluff; superabsorbent materials such as superabsorbent particles and fibers; inorganic absorbent materials and treated polymeric staple fibers and the like; or a non-absorbent material, such as non-absorbent staple fibers or non-absorbent particles. Exemplary coform materials are disclosed in commonly assigned U.S. Pat. No. 5,350,624 to Georger et al.; U.S. Pat. No. 4,100,324 to Anderson et al.; and U.S. Pat. No. 4,818,464 to Lau et al, U.S. Pat. No. 5,720,832 to Minto et al.; the entire contents of each is hereby incorporated by reference. In addition, coform material containing superabsorbent particles is disclosed in U.S. Pat. No. 4,429,001 to Koplin, also hereby incorporated in its entirety.

As used herein the term "spunbond fibers" refers to small diameter fibers of molecularly oriented polymeric material. Spunbond fibers may be formed by extruding molten thermoplastic material as filaments from a plurality of fine, usually circular capillaries of a spinneret with the diameter of the extruded filaments then being rapidly reduced as in, for example, U.S. Pat. No.4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al. Spunbond fibers are generally not tacky when they are deposited onto a collecting surface and are generally continuous. Spunbond fibers are often about 10 microns or greater in diameter. However, fine fiber spunbond webs (having an average fiber diameter less than about 10 microns) may be achieved by various methods including, but not limited to, those described in commonly assigned U.S. Pat. No. 6,200,669 to Marmon et al. and U.S. Pat. No. 5,759,926 to Pike et al., each is hereby incorporated by reference in its entirety.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "multicomponent fibers" refers to fibers or filaments which have been formed from at least two polymers extruded from separate extruders but spun together to form one fiber. Multicomponent fibers are also sometimes referred to as "conjugate" or "bicomponent" fibers or filaments. The term "bicomponent" means that there are two polymeric components making up the fibers. The polymers are usually different from each other, although conjugate fibers may be prepared from the same polymer, if the polymer in each component is different from one another in some physical property, such as, for example, melting point or the softening point. In all cases, the polymers are arranged in substantially constantly positioned distinct zones across the cross-section of the multicomponent fibers or filaments and extend continuously along the length of the multicomponent fibers or filaments. The configuration of such a multicomponent fiber may be, for example, a sheath/core arrangement, wherein one polymer is surrounded by another, a side-by-side arrangement, a pie arrangement or an "islands-in-the-sea" arrangement. Multicomponent fibers are taught in U.S. Pat. No. 5,108,820 to Kaneko et al.; U.S. Pat. No. 5,336,552 to Strack et al.; and U.S. Pat. No. 5,382,400 to Pike et al.; the entire content of each is incorporated herein by reference. For two component fibers or filaments, the polymers may be present in ratios of 75/25, 50/50, 25/75 or any other desired ratios.

As used herein, the term "multiconstituent fibers" refers to fibers which have been formed from at least two polymers extruded from the same extruder as a blend or mixture. Multiconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Fibers of this general type are discussed in, for example, U.S. Pat. Nos. 5,108,827 and 5,294,482 to Gessner.

As used herein, the term "pattern bonded" refers to a process of bonding a nonwoven web in a pattern by the application of heat and pressure or other methods, such as ultrasonic bonding. Thermal pattern bonding typically is carried out at a temperature in a range of from about 80° C. to about 180° C. and a pressure in a range of from about 150 to about 1,000 pounds per linear inch (59-178 kg/cm). The pattern employed typically will have from about 10 to about 250 bonds/inch$^2$ (1-40 bonds/cm$^2$) covering from about 5 to about 30 percent of the surface area. Such pattern bonding is accomplished in accordance with known procedures. See, for example, U.S. Design Pat. No. 239,566 to Vogt, U.S. Design Pat. No. 264,512 to Rogers, U.S. Pat. No. 3,855,046 to Hansen et al., and U.S. Pat. No. 4,493,868 to Meitner et al. and U.S. Pat. No. 5,858,515 to Stokes et al., for illustrations of bonding patterns and a discussion of bonding procedures, which patents are incorporated herein by reference. Ultrasonic bonding is performed, for example, by passing the multilayer nonwoven web laminate between a sonic horn and anvil roll as illustrated in U.S. Pat. No. 4,374,888 to Bornslaeger, which is hereby incorporated by reference in its entirety.

As used herein, through-air bonding or "TAB" means a process of bonding a nonwoven fiber web in which air, which is sufficiently hot to melt one of the polymers of which the fibers of the web are made, is forced through the web. The air velocity is between 100 and 500 feet per minute and the dwell time may be as long as 10 seconds. The melting and resolidification of the polymer provides the bonding. Through-air bonding has relatively restricted variability and since through-air bonding requires the melting of at least one component to accomplish bonding, it is generally restricted to webs with two components like conjugate fibers or those which include an adhesive. In the through-air bonder, air having a temperature above the melting temperature of one component and below the melting temperature of another component is directed from a surrounding hood, through the web, and into a perforated roller supporting the web. Alternatively, the through-air bonder may be a flat arrangement wherein the air is directed vertically downward onto the web. The operating conditions of the two configurations are similar, the primary difference being the geometry of the web during bonding. The hot air melts the lower melting polymer component and thereby forms bonds between the filaments to integrate the web.

As used herein the term "denier" refers to a commonly used expression of fiber thickness which is defined as grams per 9000 meters. A lower denier indicates a finer fiber and a higher denier indicates a thicker or heavier fiber. Denier can be converted to the international measurement "dtex", which is defined as grams per 10,000 meters, by dividing denier by 0.9.

DESCRIPTION OF TEST METHODS

The "reciprocating abrasion test" (RAT) involves stroking a sample, usually 5.5 inch by 7 inch (140 mm by 180 mm) of fabric with a silicone rubber abrasive and then evaluating the fabric for pilling, roping and fuzzing. The horizontally reciprocating dual head abrasion tester used herein is the Model no. 8675 from United States Testing Company, Inc. of Hoboken N.J. The abradant, silicone solid rubber fiber glass reinforced material has a rubber surface hardness of 81 A Durometer, a Shore A of 81 plus or minus 9 and is 36 inches (914 mm) by 4 inches (102 mm) by 0.005 inches (0.127 mm) thick and is available as catalogue no. 4050 from Flight Insulations Inc., distributors for Connecticut Hard Rubber, 925 Industrial Park Drive N.E., Marietta, Ga. 30065. Prior to testing, the sample and equipment should be conditioned to standard temperature and humidity. The abradant should be conditioned by cycling it over a scrap piece of the material to be tested about 200 times. The test sample should be free of folds, creases etc., mounted in the instrument on cork backing and cleaned of residual surface fibers with a camel hair brush. The abradant arm should be lowered and the cycling begun at a total weight of 2.6 lb. (1180 gms) with half of the weight on each of the two abradant arms. After a set number of cycles, each sample is removed from the machine and compared to a standard set of photographs. Each sample is assigned a number based on a comparison of the abraided material to the standard photograph. Five (5) is the best rating with one (1) being the worst rating.

Figure 5:
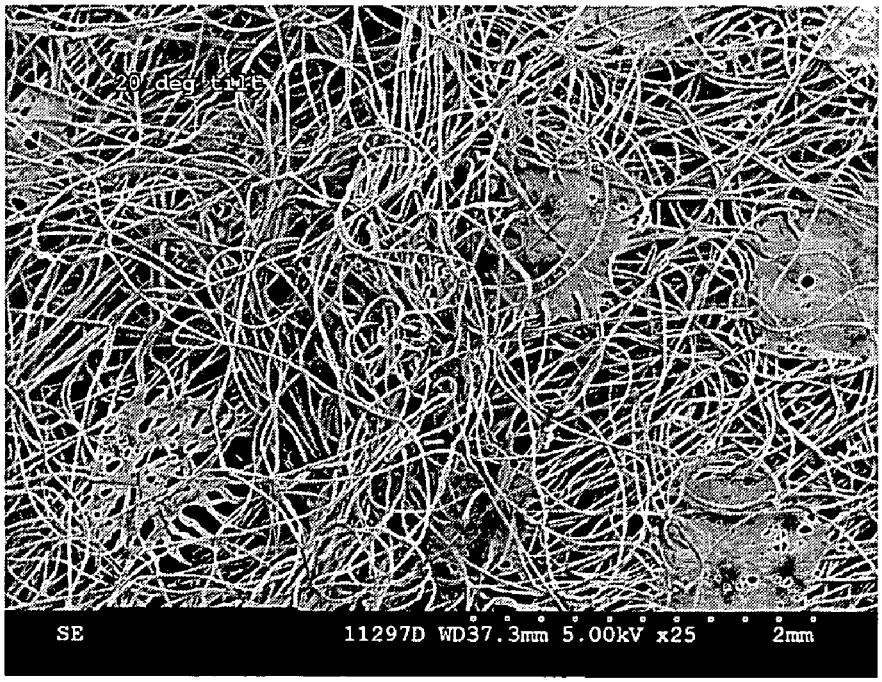
FIG. 5 is a micrograph of the abraided surface of a nonwoven outside the present invention.
Figure 6:
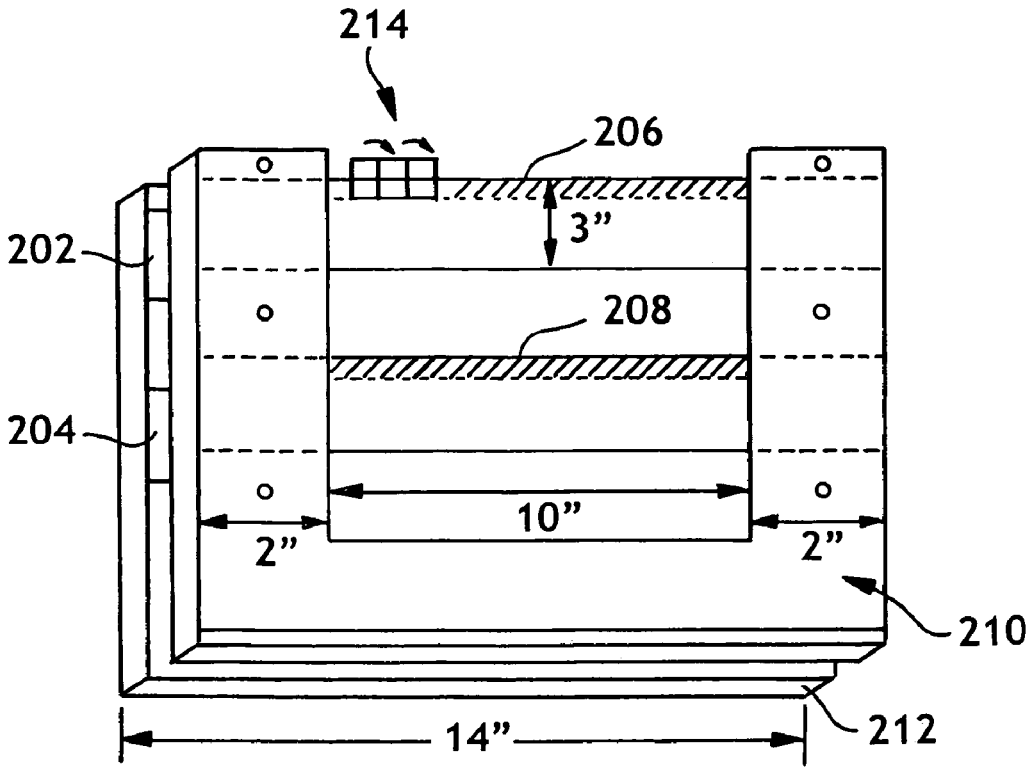
FIG. 6 is a perspective view of the fixture used to conduct the fuzz-on-edge test as described below.
Figure 7:
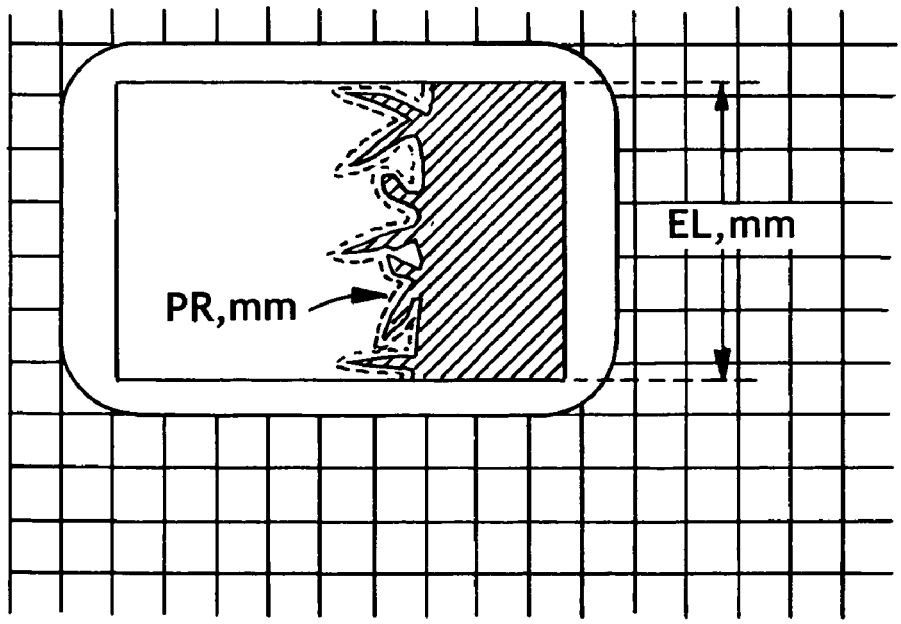
FIG. 7 is a diagrammatical view showing the measurements taken during the fuzz-on-edge test.

The "fuzz-on-edge" test is used to determine the "fuzziness" of the surface of the nonwoven web produced by the present invention. The fuzz-on-edge test measures the intensity of protruding fiber loft in perimeter length per unit-edge length. The image analysis data are taken from two glass plates made into one fixture. Each plate has a sample folded over the edge with the sample folded in the CD direction and placed over the glass plate. The edge is beveled to 1/16" thickness. The testing method and equipment is further described and disclosed in U.S. Pat. Nos. 5,509,915 and 6,585,855, the entire disclosure of each is hereby incorporated herein by reference. Referring to FIG. 5, one embodiment of a fixture that can be used in conducting the fuzz-on-edge test is shown.

As illustrated, the fixture includes a first glass plate 202 and a second glass plate 204. Each of the glass plates have a thickness of ¼ inch. Further, glass plate 202 includes a beveled edge 206 and glass plate 204 includes a beveled edge 208. Each beveled edge has a thickness of 1/16 inch. In this embodiment, the glass plates are maintained in position by a pair of U-shaped brackets 210 and 212. Brackets 210 and 212 can be made from, for instance ¾ inch finished plywood.

During testing, samples are placed over the beveled edges 206 and 208. Multiple images of the folded edges are then taken along the edge as shown at 214. Thirty (30) fields of view are examined on each folded edge to give a total of sixty (60) fields of view. Each view has "PR/EL" measured before and after removal of protruding fibers. "PR/EL" is perimeter per edge-length examined in each field-of-view. FIG. 11 illustrates the measurement taken. As shown, "PR" is the perimeter around the protruding fibers while "EL" is the length of the measured sample. The PR/EL valves are averaged and assembled into a histogram as an output page. This analysis is completed and the data is obtained using the QUANTIMET 970 Image Analysis System obtained from Leica Corp. of Deerfield, Ill. The QUIPS routine for performing this work, FUZZ10, is as follows:

```
Cambridge Instruments QUANTIMET 970 QUIPS/MX:
VO8.02 USER:
ROUTINE: FUZZIO DATE: May 8, 1981 RUN: 0 SPECI
  MEN:
NAME=FUZZB
DOES=PR/EL ON Nonwovens; GETS HISTOGRAM
AUTH=B. E. KRESSNER
DATE=DEC. 10, 1997
COND=MACROVIEWER; DCI 12×12; FOLLIES PINK
  FILTER; 3□3 MASK 60 MM MICRO-NIKKO,F/4; 20
  MM EXTENSION TUBES; 2 PLATE (GLASS) FIX-
  TURE MICRO-NIKKOR AT FULL EXTENSION FOR
  MAX MAG!!!!
ROTATE CAM 90 deg SO THAT IMAGE ON RIGHT
  SIDE!!
ALLOWS TYPICAL PHOTO
Enter specimen identity
Scanner (No.1 Chalnicon LV=0.00 SENS=2.36 PAUSE)
Load Shading Corrector (pattern—FUZZ7)
Calibrate User Specified (Cal Value—9.709 microns per
  pixel)
SUBRTN STANDARD
TOTPREL:=0.
TOTFIELDS:=0.
PHOTO:=0.
MEAN:=0.
If PHOTO=1. then
Pause Message
WANT TYPICAL PHOTO (1=YES; 0=NO)?
Input PHOTO
Endif
If PHOTO=1. then
Pause Message
INPUT MEAN VALUE FOR PR/EL
Input MEAN
Endif
For SAMPLE=1 to 2
If SAMPLE=1. then
```

```
STAGEX:=36000.
STAGEY:=144000.
Stage Move (STAGEX,STAGEY)
Pause Message
please position fixture
Pause
STAGEX:=120000.
STAGEY:=144000.
Stage Move (STAGEX,STAGEY)
Pause Message
please focus
Detect 2D (Darker than 54, Delin PAUSE)
STAGEX:=36000.
STAGEY:=144000.
Endif
If SAMPLE=2. then
STAGEX:=120000.
STAGEY:=44000.
Stage Move (STAGEX,STAGEY)
Pause Message
please focus
Detect 2D (Darker than 54, Delin)
STAGEX:=36000.
STAGEY:=44000.
Endif
Stage Move (STAGEX,STAGEY)
Stage Scan (X Y
scan origin STAGEX STAGEY
field size 6410.0 78000.0
no of fields 30 1)
For FIELD
If TOTFIELDS=30. then
Scanner (No. 1 Chalnicon AUTO-SENSITIVITY
LV=0.01)
Endif
Live Frame is Standard Image Frame
Image Frame is Rectangle (X: 26, Y: 37, W: 823, H: 627,)
Scanner (No. 1 Chalnicon AUTO-SENSITIVITY
LV=0.01)
Image Frame is Rectangle (X: 48, Y: 37, W: 803, H: 627,)
Detect 2D (Darker than 54, Delin)
Amend (OPEN by 10)
Measure field—Parameters into array FIELD
BEFORPERI:=FIELD PERIMETER
Amend (OPEN by 10)
Measure field—Parameters into array FIELD
AFTPERIM:=FIELD PERIMETER
PROVEREL:=((BEFORPERI—AFTPERIM)/(I.F-
  RAME.H* CAL.CONST))
TOTPREL:=TOTPREL+PROVEREL
TOTFIELDS:=TOTFIELDS+1.
If PHOTO=1. then
If PROVEREL>(0.95000*MEAN) then
If PROVEREL<(1.0500*MEAN) then
Scanner (No. 1 Chalnicon AUTO-SENSITIVITY LV=0.01
  PAUSE)
Detect 2D ( Darker than 53 and Lighter than 10, Delin
  PAUSE)
Endif
Endif
Endif
Distribute COUNT vs PROVEREL (Units MM/MM)
into GRAPH from 0.00 to 5.00 into 20 bins, differential
Stage Step
Next FIELD
Next
Print " "
Print "AVE PR-OVER-EL (UM/UM)=", TOTPREL/TOT-
  FIELDS
Print " "
Print "TOTAL NUMBER OF FIELDS=", TOTFIELDS
Print " "
Print "FIELD HEIGHT (MM)=",
  I.FRAME.H*CAL.CONST/ 1000
Print " "
Print " "
Print Distribution (GRAPH, differential, bar chart,
  scale=0.00)
For LOOPCOUNT=1 to 26
Print " "
Next
END OF PROGRAM
```

Stylus profilometry is a test method which allows measurements of the surface irregularity of a material using a stylus which is drawn across the surface of a material. As the stylus moves across the material, data is generated and is fed into a computer to track the surface profile sensed by the stylus. This information can in turn be plotted to show the degree of deviation from a standard reference line and thus demonstrate the degree of irregularity of a material. Surface profilometry data was generated for Examples 1 and Comparative Example 2.

The surface, which is formed against the liner material, in the material of Examples 1, and the surface formed against the forming wire in Comparative Example 2, were scanned using a Model S5 Talysurf surface profileometer manufactured by Taylor-Hobson. The stylus used a diamond tip with a nominal 2 micron radius (Part #112/1836). Prior to data collection, the stylus was calibrated against a highly polished tungsten carbide steel ball standard of known radius (22.0008 millimeters) and finish (Part #112/1844). During testing, the vertical position of the stylus tip was detected by a helium/neon laser interferometer pick-up (Part #112/2033). The data were collected and processed using Form Talysurf Version 5.02 software running on an IBM PC compatible computer. The stylus tip was drawn across the sample surface at a speed of 0.5 millimeters per minute. The paths tracked by the stylus of the profilometer were across the top surface of the materials.

To perform the procedure, a 12 mm by 12 mm sample was selected for scanning. The central 6 mm by 6 mm portion were selected for scanning. A scan consisting of 256 data-logged profiles was taken from the surface being scanned using the diamond tip stylus. Each 12 mm long profile was spaced apart by 46.8 microns, with data points being collected at 0.25 microns apart. Data was only recorded for the central 6 mm by 6 mm of each sample. The parameters measured or calculated include average surface roughness (Sa), root mean square roughness (Sq), highest peak (Sp), deepest valley (Sv) and the 10 point height (Sz) which is mean distance between the five highest peaks and the 5 deepest valleys.

DETAILED DESCRIPTION OF THE INVENTION

The nonwoven web of the present invention is prepared by a process including the steps of:

a. providing a forming surface;
b. supplying a liner material onto the forming surface;
c. forming a nonwoven web on the liner material;
d. bonding the nonwoven web to form a bonded nonwoven web which is at least partially bonded to the liner; and
e. removing the bonded nonwoven web from the liner material.

It has been discovered that an abrasion resistant nonwoven web having a high degree of surface roughness and a low degree of free fibers on the surface can be formed by using the process of the present invention. In the process of the present invention, the forming of the nonwoven web may accomplished by any known nonwoven web forming process. For example, the nonwoven web may be formed by a spunbond process, a meltblown process, an air-laid process, a carding process or a coform process. When made by the process of the present invention, the nonwoven web has at least one surface which is abrasion resistant, has a surface roughness of at least 20 μm, and has a fuzz-on-edge value less than about 1.0 mm/mm.

The fuzz-on-edge is measured by the method described above and is a measure of the intensity of the protruding fiber loft in perimeter length per unit-edge length. In the present invention, the fuzz-on-edge is less than about 1.0 mm/mm and is generally between 0.001 mm/mm and 0.9 mm/mm. Ideally, the fuzz-on-edge is less than about 0.5 mm/mm.

The surface roughness of the nonwoven web of the present invention is measured as described above and is at least about 20 μm. Generally, the surface roughness is in the range of about 20 μm to about 100 μm, and usually between about 20 μm and about 35 μm.

The fibers of the nonwoven web may be monocomponent, multicomponent or multiconstituent fibers. Mixtures of these types of fibers may also be used. Of these types of fibers, it is generally preferred that the fibers contain multicomponent fibers, especially in applications where lofty nonwoven webs are desired. In addition, the fibers may be crimped or uncrimped. Further, the fibers of the nonwoven web of the present invention can be made from thermoplastic polymers.

Suitable thermoplastic polymers useful in preparing the thermoplastic fibers of the nonwoven web of the present invention include polyolefins, polyesters, polyamides, polycarbonates, polyurethanes, polyvinylchloride, polytetrafluoroethylene, polystyrene, polyethylene terephthalate, biodegradable polymers such as polylactic acid and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly(1-butene) and poly(2-butene); polypentene, e.g., poly(1-pentene) and poly(2-pentene); poly(3-methyl-1-pentene); poly(4-methyl 1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polytrimethylene terephthalate, polybutylene terephthalate, polytetramethylene terephthalate, polycyclohexylene-1,4-dimethylene terephthalate, and isophthalate copolymers thereof, as well as blends thereof.

Many polyolefins are available for fiber production, for example polyethylenes such as Dow Chemical's ASPUN 6811A linear low-density polyethylene, 2553 LLDPE and 25355 and 12350 high density polyethylene are such suitable polymers. The polyethylenes have melt flow rates in g/10 min. at 190° F. and a load of 2.16 kg, of about 26, 40, 25 and 12, respectively. Fiber forming polypropylenes include, for example, Basell's PF-015 polypropylene. Many other polyolefins are commercially available and generally can be used in the present invention. The particularly preferred polyolefins are polypropylene and polyethylene.

Examples of polyamides and their methods of synthesis may be found in "Polyamide Resins" by Don E. Floyd (Library of Congress Catalog number 66-20811, Reinhold Publishing, N.Y., 1966). Particularly commercially useful polyamides are nylon 6, nylon-6,6, nylon-11 and nylon-12. These polyamides are available from a number of sources such as Custom Resins, Nyltech, among others. In addition, a compatible tackifying resin may be added to the extrudable compositions described above to provide tackified materials that autogenously bond or which require heat for bonding. Any tackifier resin can be used which is compatible with the polymers and can withstand the high processing (e.g., extrusion) temperatures. If the polymer is blended with processing aids such as, for example, polyolefins or extending oils, the tackifier resin should also be compatible with those processing aids. Generally, hydrogenated hydrocarbon resins are preferred tackifying resins, because of their better temperature stability. REGALREZ® and ARKON® P series tackifiers are examples of hydrogenated hydrocarbon resins. ZONATAC® 501 Lite is an example of a terpene hydrocarbon. REGALREZ® hydrocarbon resins are available from Hercules Incorporated. ARKON®P series resins are available from Arakawa Chemical (USA) Incorporated. The tackifying resins such as disclosed in U.S. Pat. No. 4,787,699, hereby incorporated by reference, are suitable. Other tackifying resins which are compatible with the other components of the composition and can withstand the high processing temperatures can also be used.

The nonwoven web of the present invention can be used in a variety of different applications, including, for example, as a filter medium, as a wipe, as a thermal or acoustical insulation material and as components in personal care products, such as diapers. In addition, the nonwoven web can be used in any application where nonwoven webs have been previously used.

In order to have a better understanding of the process of the present invention, FIG. 1 generally illustrates a process 10 for producing a nonwoven web of the present invention. In the process, the liner material 29 is supplied from a roll 27 onto a forming surface 26. The forming surface is supported by a set of rollers 28. The fibers 23 of the nonwoven web 50 are produced using a nonwoven web forming process 21 and are deposited on top of the liner 29 which is adjacent to the forming surface. It is noted that the specific process of forming the nonwoven web can vary depending on the type of nonwoven web desired.

Next, the nonwoven web 50, which is unbonded, and the liner are bonded. As shown in FIG. 1, the unbonded nonwoven web 50 is then bonded in a bonder, such as a through-air bonder 36, to provide coherency and physical strength. The use of a through-air bonder is particularly useful for the present invention in that the bonder produces a highly bonded nonwoven web without applying significant compacting pressure. Through-air bonders are especially preferred when a lofty structure is desired and when multicomponent fibers are used to produce the nonwoven web. In the through-air bonder 36, a flow of heated air is applied through the web, e.g., from a hood 40 to a perforated roller 38, to heat the web to a temperature above the melting point of a component of the fibers of the nonwoven web. The bonding process may be assisted by a vacuum device that is placed underneath the perforated roller 38.

Other bonding processes may be used in the present invention, including, but not limited to, powder adhesive bonding, liquid adhesive bonding, ultrasonic bonding, compaction roll bonding. These bonding processes are conventional and well known in the art. Among these bonding processes, through-air bonding processes are particularly suitable for the present invention since the bonding processes bond the multicomponent fiber webs without applying any substantial compacting pressure and, thus, produce lofty, uncompacted web. Similarly, the nonwoven webs of monocomponent fibers, including staple fiber webs and spunbond fiber webs, can be bonded with the above-disclosed bonding processes other than through-air bonding processes. Through-air bonding processes are not particularly suitable for monocomponent fiber webs unless the processes are used in conjunction with powder adhesive bonding or fluid adhesive bonding processes since through-air bonding processes, which to melt a component of the web fibers to effect bonds.

Once bonded, the liner material 29 is removed from the bonded nonwoven web. Any method can be used to remove the liner, so long as the formed nonwoven web is not damaged. The nonwoven web may be further processed in-line or, as shown, rolled onto a roll 31, for processing at a later time.

The liner material useful in the present invention includes films, woven and nonwoven materials. Desirably, the liner material should be a low cost material since the liner material may be discarded after use. It is noted, however, the liner material may be reused, provided that the liner is not damaged in the processing. Exemplary materials for the liners are thermoplastic polymer based materials, such as films, nonwoven webs and woven webs. Of these materials, nonwoven webs are preferred from a standpoint of cost. Particularly, a light basis weight spunbond material is generally selected. For example, a spunbond nonwoven web having a basis weight between about 5 to about 35 gsm and more desirably between about 13 and 23 gsm. Although not required, the liners should be made from a thermoplastic polymer which is different from the thermoplastic polymer used to produce the nonwoven web. Further, it is desirable that the thermoplastic polymer of the liner material which is somewhat incompatible with the one of the thermoplastic polymers of the formed nonwoven web. For example, if the formed nonwoven web is formed from bicomponent fibers of polyethylene and polypropylene, with the polyethylene making up a portion of the outer surface of the fibers, then a polypropylene spunbond can be used as the liner. Selecting the liner with this in mind aids the release of the liner from the nonwoven web.

Using the process of the present invention to produce the nonwoven web, the side of the nonwoven web which is adjacent the liner is abrasion resistant, has a high degree of surface roughness and a low degree of free fibers on the surface. The other side of the nonwoven web will typically have similar properties to a nonwoven web produced using a conventional process. However, two of the nonwoven webs produced in the present invention can be laminated together such that the abrasion resistant, rough surface of the two nonwoven webs are on opposite sides of the resulting laminate. In addition, other layers may be formed on the nonwoven web, away from the side in which the liner is attached, forming a laminate structure.

Additionally, it is desirable that the nonwoven have a bond area of at least 20%. One example of a pattern has points and is the Hansen Pennings or "H&P" pattern with about a 30% bond area when new and with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm).

The nonwoven web and laminates of the present invention may have an overall density between about 0.005 g/cm$^3$ and about 0.3 g/cm$^3$, preferably between about 0.01 g/cm$^3$ and about 0.2 g/cm$^3$, and more preferably between about 0.02 g/cm$^3$ and about 0.15 g/cm$^3$. The basis weight of the nonwoven web ranges from about 8 to about 500 grams per square meter (gsm), or greater preferably from about 13 to about 475 gsm, and more preferably from about 16 to about 440 gsm, depending on the application in which the nonwoven web is to be used.

The present invention also provides a lofty nonwoven web from multicomponent fibers having at least one surface with improved abrasion resistance and fuzziness over other multicomponent fiber nonwoven webs. This nonwoven web has a surface roughness of at least 20 μm, a fuzz-on-edge less than 1.0 mm/mm. The abrasion resistant surface of the nonwoven web exhibits very little, if any, roping or fuzzing. This lofty nonwoven web is particularly suitable as a filter medium.

When used as a filter medium, the fibers particularly suitable for the filter medium include crimped spunbond fibers and crimped staple fibers. As stated above, these fibers can be monocomponent fibers or multicomponent conjugate fibers. Suitable spunbond fibers and staple fibers for the present invention have an average diameter of about 1 μm to about 100 μm, and in particular, between about 10 μm to about 50 μm. Of these crimped fibers, particularly suitable fibers are multicomponent conjugate fibers that contain two or more component polymers, and more particularly suitable fibers are multicomponent conjugate fibers containing polymers of different melting points. Preferably, the melting point difference between the highest melting polymer and the lowest melting polymer of the conjugate fibers should be at least about 5° C., more preferably about 30° C., so that the lowest melting polymer can be melted without affecting the chemical and physical integrities of the highest melting polymer.

The preferred nonwoven web for filter applications is through-air bonded nonwoven webs fabricated from crimped multicomponent conjugate fibers, and more particularly suitable conjugate fibers are spunbond conjugate fibers. For illustration purposes, the present invention hereinafter is directed to bicomponent spunbond conjugate fibers (hereinafter referred to as bicomponent fibers) and bicomponent fiber webs, and to a through-air bonding process although other spunbond or staple conjugate fibers of more than two polymers and other bonding processes can be utilized for the present invention, as discussed above.

In accordance with the present invention, the suitable bicomponent fibers have the low melting component polymer at least partially exposed to the surface along the entire length of the fibers. Suitable configurations for the bicomponent fibers include side-by-side configurations and sheath-core configurations, and suitable sheath-core configurations include eccentric sheath-core, islands-in-the-sea configurations and concentric sheath-core configurations. Of these sheath-core configurations, eccentric sheath-core configurations are particularly useful since imparting crimps on eccentric sheath-core bicomponent fibers can be effected more easily. If a sheath-core configuration is employed, it is highly desired to have the low melting polymer form the sheath.

A wide variety of combinations of thermoplastic polymers known to form fibers and/or filaments can be employed to produce the conjugate fibers provided that the selected polymers have sufficiently different melting points and, preferably, different crystallization and/or solidification properties. The melting point differences between the selected polymers facilitate the through-air bonding process, and the differences in the crystallization and solidification properties promote fiber crimping, especially crimping through heat activation of latent crimps.

The multicomponent fibers have from about 20% to about 80%, preferably from about 40% to about 60%, by weight of the low melting polymer and from about 80% to about 20%, preferably about 60% to about 40%, by weight of the high melting polymer.

Figure 2:
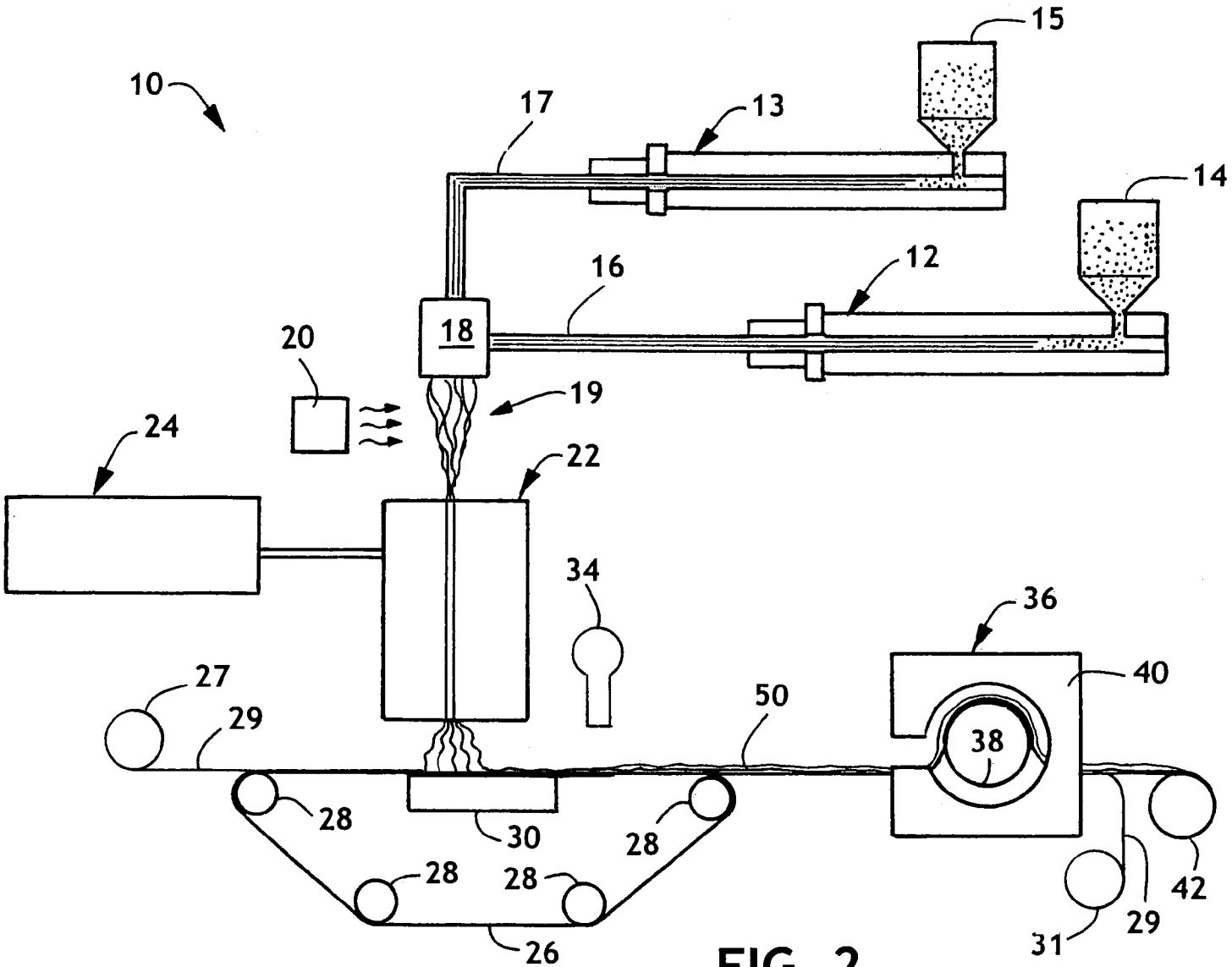
FIG. 2 shows an exemplary process for producing the lofty nonwoven web from multicomponent fibers of the present invention.

To illustrate the process of the present invention using the multicomponent spunbond fiber nonwoven web, attention is directed to FIG. 2. In FIG. 2, the process line 10A includes a pair of extruders 12 and 13 for separately supplying extruded polymer components, a high melting polymer and a low melting polymer, to a bicomponent spinneret 18. Hoppers 14 and 15 supply the polymer to the extruders 12 and 13, respectively. Spinnerets for producing bicomponent fibers are well known in the art and thus are not described herein. In general, the spinneret 18 includes a housing containing a spin pack which includes a plurality of plates having a pattern of openings arranged to create flow paths for directing the high melting and low melting polymers to each fiber-forming opening in the spinneret. The spinneret 18 has openings arranged in one or more rows, and the openings form a downwardly extending curtain of fibers when the polymers are extruded through the spinneret.

The line 10A further includes a quenching gas outlet 20 adjacently positioned to the curtain of fibers 16 extending from the spinneret 18, and the gas from the outlet 20 at least partially quenches, i.e., the polymer forming the fibers is no longer able to freely flow, and develops a latent helical crimp in the extending fibers 17. As an example, an air stream of a temperature between about 45° F. (7.2° C.) and about 90° F. (32° C.) which is directed substantially perpendicular to the length of the fibers at a velocity from about 100 to about 400 feet per minute can be effectively used as a quenching gas. Although the quenching process is illustrated with a one-outlet quenching system, more than one quenching gas outlets can be utilized.

A fiber draw unit or an aspirator 22 is positioned below the quenching gas outlet and receives the quenched fibers. Fiber draw units or aspirators for use in melt spinning polymers are well known in the art, and exemplary fiber draw units suitable for the present invention include a linear fiber aspirator of the type shown in U.S. Pat. No. 3,802,817 to Matsuki et al. and eductive guns of the type shown in U.S. Pat. No. 3,692,618 to Dorshner et al. and U.S. Pat. No. 3,423,266 to Davies et al.

The fiber draw unit 22, in general, has an elongated passage through which the fibers are drawn by aspirating gas. The aspirating gas may be any gas, such as air, that does not adversely interact with the polymer of the fibers. The aspirating gas may be heated above room temperature, at room temperature or below room temperature. The actual temperature of the aspirating gas is not critical to the present invention. By way of an example, the aspirating gas may be heated using a temperature adjustable heater 24. It is noted, however, that the aspirating gas does not have to be heated in the present invention.

If the aspirating gas in heated, the aspirating gas draws the quenched fibers and heats the fibers to a temperature that is required to activate the latent crimp thereon. The temperature required to activate the latent crimp on the fibers ranges from about 110° F. (43.3° C.) to a maximum temperature which is slightly above the melting point of the low melting component polymer. Generally, a higher air temperature produces a higher number of crimps. One of the important advantages of the present fiber web forming process is that the crimp density, i.e., the number of crimps per unit length of a fiber, of the fibers and thus the density and pore size distribution of the resulting webs can be controlled by controlling the temperature of the aspirating gas, providing a convenient way to engineer nonwoven webs to accommodate different needs of different applications. Additionally, the crimp density can be controlled to some degree by regulating the amount of potential latent crimps that can be heat activated, and the amount of potential latent crimps can be controlled by varying the spinning conditions, such as melt temperature and aspirating gas velocity. For example, higher amounts of potential latent crimps can be imparted on polyethylene/polypropylene bicomponent fibers by supplying lower velocities of aspirating gas.

If the aspirating air is unheated or below room temperature, the heater 24 acts as a blower and supplies aspirating air to the fiber draw unit 22. The aspirating air draws the filaments and ambient air through the fiber draw unit. The aspirating air in the formation of the post formation crimped filaments is unheated and is at or about ambient temperature. The ambient temperature may vary depending on the conditions surrounding the apparatus used in the process of FIG. 2. Generally, the ambient air is in the range of about 65° F. (18° C.) to about 85° F. (29.4° C.); however, the temperature may be slightly above or below this range. If the fibers are drawn with ambient temperature or below, the crimp of the fibers can be activated by heating the fibers briefly, such as with a hot air knife ("HAK") 31, prior to bonding. The activation of the crimp in the post formation process will be described in more detail below.

The drawn fibers 23 are then deposited onto a liner material 29, which is supplied to the process from a roll 37. The liner material is placed onto a continuous forming surface 26 and the drawn fibers are deposited onto the liner in a random manner. The fiber depositing process preferably is assisted by a vacuum device 30 placed underneath the forming surface. The vacuum force largely eliminates the undesirable scattering of the fibers and guides the fibers onto the forming surface to form a uniform unbonded web of continuous fibers. The resulting web can be lightly compressed by a compression roller 32, if a light compaction of the web is desired to provide enhanced integrity to the unbonded web before the web is subjected to a bonding process. Generally, compression of the web should be avoided if a lofty structure is desired.

If the fibers do not have the crimp activated, then the filaments of the nonwoven web are then optionally heated by traversal under one of a hot air knife (HAK) or hot air diffuser 34. Generally, it is preferred that the filaments of the nonwoven web are heat treated. A conventional hot air knife includes a mandrel with a slot that blows a jet of hot air onto the nonwoven web surface. Such hot air knives are taught, for example, by U.S. Pat. No. 5,707,468 to Arnold, et al. A hot air diffuser is an alternative to the HAK which operates in a similar manner but with lower air velocity over a greater surface area and thus uses correspondingly lower air temperatures. Depending on the conditions of the hot air diffuser or hot air knife (temperature and air flow rate) the filaments may receive an external skin melting or a small degree of bonding during this traversal through the first heating zone. This bonding is usually only sufficient only to hold the filaments in place during further processing; but light enough so as to not hold the fibers together when they need to be manipulated manually. Compaction of the nonwoven web should be avoided as much as possible. Such bonding may be incidental or eliminated altogether, if desired.

The unbonded web is then bonded in a bonder, such as a through-air bonder 36, to provide coherency and physical strength. The use of a through-air bonder is particularly useful for the present invention in that the bonder produces a highly bonded nonwoven web without applying significant compacting pressure. In the through-air bonder 36, a flow of heated air is applied through the web, e.g., from a hood 40 to a perforated roller 38, to heat the web to a temperature above the melting point of the low melting component polymer but below the melting point of the high melting component polymer. The bonding process may be assisted by a vacuum device that is placed underneath the perforated roller 38. Upon heating, the low melting polymer portions of the web fibers are melted and the melted portions of the fibers adhere to adjacent fibers at the cross-over points while the high melting polymer portions of the fibers tend to maintain the physical and dimensional integrity of the web. As such, the through-air bonding process turns the unbonded web into a cohesive nonwoven fiber web without significantly changing its originally engineered web dimensions, density, porosity and crimp density.

The bonding air temperature may vary widely to accommodate different melting points of different component polymers and to accommodate the temperature and speed limitations of different bonders. In addition, basis weight of the web must be considered in choosing the air temperature. It is to be noted that the duration of the bonding process should not be too long if it is desired to avoid significant shrinkage of the web. As an example, when polypropylene and polyethylene are used as the component polymers for a conjugate-fiber web, the air flowing through the through-air bonder may have a temperature between about 230° F. (110° C.) and about 280° F. (138° C.). and a velocity from about 100 to about 500 feet per minute.

The above-described through-air bonding process is a highly suitable bonding process that can be used not only to effect high strength interfiber bonds without significantly compacting the webs, but also to impart a density gradient across the depth of the webs, if desired. The density gradient imparted filter media that are produced with the through-air bonding process have the highest fiber density at the region where the fibers contact the web supporting surface, e.g., the perforated roller 33. Although it is not wished to be bound by any theory, it is believed that during the through-air bonding process, the fibers across the depth of the web toward the web supporting surface are subjected to increasing compacting pressures of the web's own weight and of the flows of the assist vacuum and the bonding air, and, thus, a desirable fiber density gradient may be imparted in the resulting web when proper settings in the bonder are employed.

The filter medium produced in accordance with the present invention is a lofty, low density medium that can retain a large quantity of contaminants without impeding the filtrate flow or causing a high pressure drop across the filter medium. The highly porous, three-dimensional loft of the present filter medium promotes the mechanical entrapment of contaminants within its interstitial spaces, while providing alternate channels for the filtrate to flow through. In addition, the filter medium may contain a density gradient of fibers across its depth, adding to the advantages of the present filter medium. As stated above, a fiber density gradient in filter media improves the filter efficiency and service life.

Alternatively, a filter medium containing a fiber density gradient can be produced by laminating two or more layers of filter media having different fiber densities. Such component filter media of different fiber densities can be prepared, for example, by imparting different levels of crimps on the fibers or utilizing fibers of different crimp levels and/or different sizes. More conveniently, if a spunbond process is used to produce the present filter medium, a fiber density gradient can be imparted by sequentially spinning fibers of different crimp levels and/or different fiber sizes and sequentially depositing the fibers onto a forming surface. This process is shown in FIG. 3.

Figure 3:
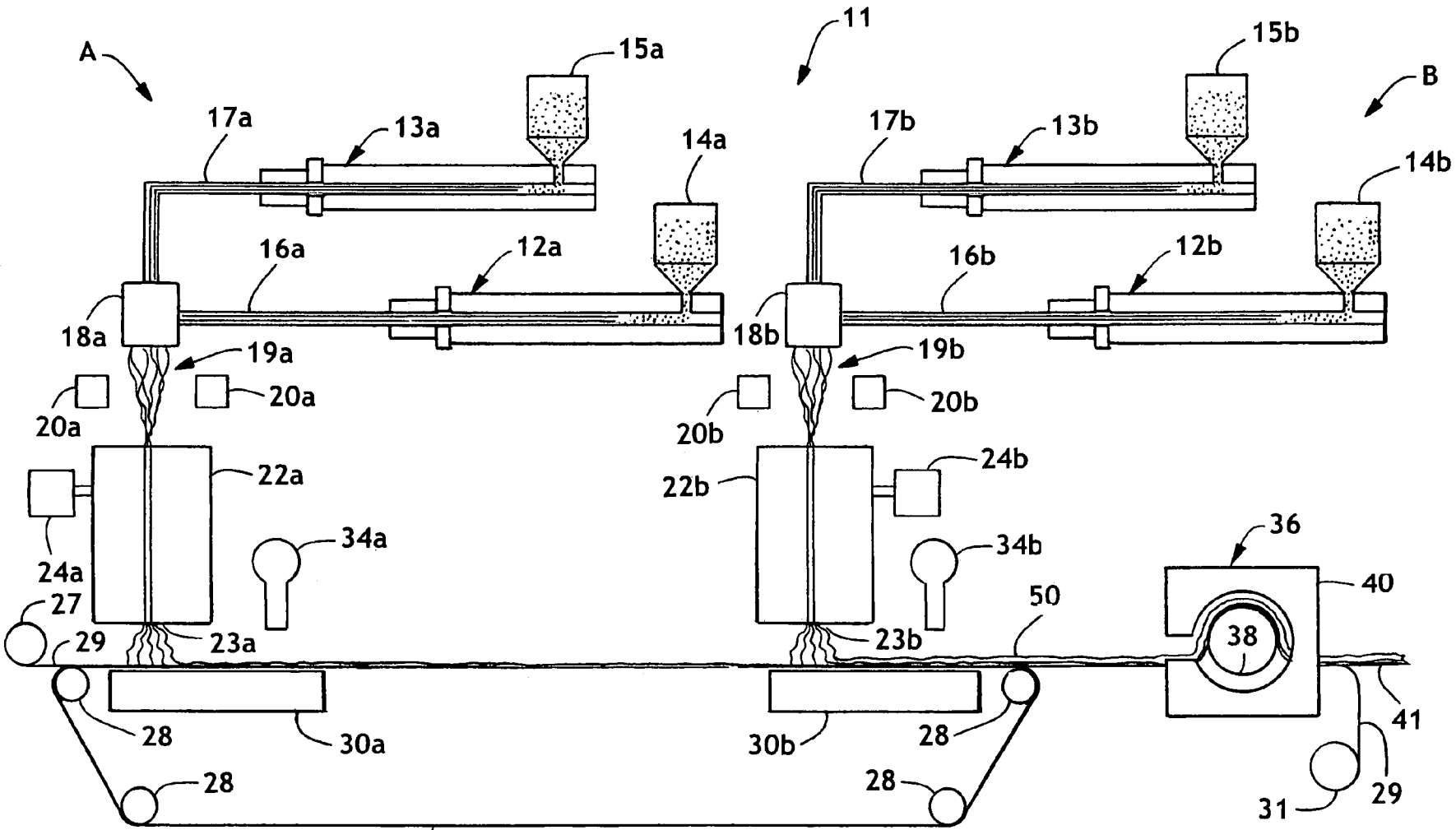
FIG. 3 shows an exemplary process for producing a nonwoven web laminate from multicomponent fibers of the present invention.

In FIG. 3, a process line 11 for preparing a low loft/high loft laminate in-line is shown. The process line, as shown, has two fiber forming processes A and B. In operating each of the fiber forming lines A and B, each of the components operates as described above for FIG. 2, with the letter "a" designating the A fiber forming process and "b" designating the B fiber forming process. Since the operation of these process components is described above, a description of the common component will not be given here.

In process 11, the A process produces the low loft multicomponent spunbond layer. This low loft layer is formed on a forming surface 26 and is heated under a hot air knife 34*a* as described above. It is noted that the temperature of the hot air knife 34*a* should be high enough soften the lower melting point component, but not too high so that a film-like material is formed from the lower melting point component. Before the low lofted layer is bonded in a through air bonder 40, the low loft layer is conveyed under the high loft forming apparatus of the B process and the high loft multicomponent spunbond layer is formed directly on the low loft layer using the process conditions described above. The two layer structure 50 is then transferred to a bonding apparatus 36, such as a through air bonder and the low loft layer and the high loft layer are firmly bonded together since the component having the low melting point is melted in both layer, hence bonding the two layers together, resulting in the multilayer laminate 41. It is noted that the process of FIG. 3 can be further modified by adding additional fiber forming processes to form a laminate with higher loft or to form a laminate with a layer of a different nonwoven material. In addition, film forming apparatus can also be inserted in the process line of FIG. 3, if desired.

Even though the particularly suitable bonding processes for the present invention are through-air bonding processes, the unbonded web can be bonded, for example, with the use of adhesives, e.g., applying a powder adhesive or spraying a liquid adhesive, while preserving the lofty structure of the present nonwoven web. Optionally, when a filter application requires different properties, such as a high tear or burst strength, from the filter media, other bonding processes, including point-bonding, ultrasonic bonding and hydroentangling processes, may be employed in addition to a low-compacting bonding process, e.g., through-air bonding process, to impart added cohesion and strength to the nonwoven web.

When used as a filter medium, the lofty abrasion resistant nonwoven web preferably has a density gradient. One way to achieve the density gradient is to form a laminate of wherein a first nonwoven web layer has a density which is greater that a second nonwoven web. In the present invention, it is desirable that the first nonwoven web has a density between about 0.05 g/cm$^3$ to about 0.30 g/cm$^3$ and the second layer has a density between about 0.005 g/cm$^3$ and less than about 0.1 g/cm$^3$. The overall laminate desirably has a basis weight of in the range from about 8 to about 500 grams per square meter (gsm), preferably from about 13 about 475 gsm, and more preferably from about 16 about 440 gsm, depending on the application in which the laminate is to be used.

When used as a filter media, the nonwoven web and laminate are suitable for fluid-borne particle filtration applications, such as filtration media for transmission fluids, hydraulic fluids, swimming pool water, coolant oil or cutting fluid for metalworking, metal forming and metal rolling, air-borne particle filtration and the like since the filter media provide high filtration efficiency, extended service life and excellent physical properties. The lofty filter media are highly suitable for liquid filtration applications. While the compacting pressure of liquid filtrate quickly accumulates contaminants and plugs up the available pores of conventional filter media fabricated from low loft media, such as uncrimped spunbond fiber or staple fiber media, the liquid compacting pressure does not as quickly affect the present lofty filter media, especially the media containing a fiber density gradient, since the lofty, gradient-imparted structure of the present filter media entraps a large amount of contaminants within the intersticial spaces without plugging up all of the intersticial flow paths. Examples of suitable liquid applications include filter media for cutting fluids and coolants of metal machining and rolling machines.

Additionally, the present lofty filter media can be used in conjunction with specialized filtration media, such as filter media that have an ultra-high filter efficiency but a limited service life, to take advantage of the beneficial properties of the two media, providing a combination filter assembly of high efficiency and long service life. Such combination filter media may be formed, for example, by laminating the present lofty filter medium with a micro filter medium, e.g., a membrane filter, meltblown fiber web filter or wet-laid fiber filter.

The following examples are provided to illustrate the present invention and are not intended to limit the scope of the present invention thereto.

EXAMPLES

Example 1

Using the process of FIG. 3, a 0.6 osy (20 gsm) polypropylene spunbond liner material was placed on the forming wire. Onto this spunbond liner, a laminate having a high density layer and a low density layer with an overall basis weight of about 5.4 osy (183 gsm) was prepared. The fibers of the high density, low loft layer were polyethylene/polypropylene side-by-side fibers containing about 1:1 weight ratio of polyethylene to polypropylene. The fibers were prepared by extruding about 0.7 grams per hole/min of the total polymer and the resulting fibers were quenched with air at 60° F. (15.5° C.) at about 5 inches (.The high density low loft layer had the fibers drawn at a FDU pressure of 6 psi and the HAK was set at 1 in (2.54 cm) above the formed web and had a temperature of 265° F. (129° C). The high density, low loft layer had a basis weight of about 2.7 osy (91.5 gsm) and a thickness of 0.9 mm.

Onto the high density, low loft layer, a low density, high loft layer was formed from polyethylene/polypropylene side-by-side fibers which were prepared by extruding about 0.5 grams per hole/min of the total polymer and were quenched with air at 60° F. (15.5° C). The low density high loft layer had the fibers drawn at a FDU pressure of 4.5 psi and the HAK was set at 5 in (12.7 cm) above the formed web and had a temperature of 235° F. (112° C.). The low density high loft layer had a basis weight of about 2.7 osy (91.5 gsm) and a thickness of 4.0 mm.

The laminate was run through a through air bonder having a air velocity of 100 ft/min (30.5 m/min) at a temperature of 265° F. (129° C.) and then cooled with ambient air. After cooling, the spunbond liner layer was removed from the laminate. The laminate had an overall bulk of 4.9 mm.

Comparative Example 1

The procedure of Example 1 were repeated, except the spunbond liner layer was not removed from the laminate.

Comparative Example 2

The procedure of Example 1 was repeated, except a spunbond liner layer was not provided on the forming wire.

A sample of each material was tested for abrasion resistance using the test procedure outlined above. The results of the abrasion testing are reproduced in Table 1 below.

TABLE 1

| | Cycles | Rat Fuzzing Inches | RAT Roping Inches | RAT Rating Rating |
|---|---|---|---|---|
| Example 1 | 11 | 0.3 | 0.3 | 5 |
| | 35 | 0.3 | 0.4 | 5 |
| | 45 | 0.3 | 0.5 | 5 |
| | Average | 0.3 | 0.4 | 5 |
| | Std. Dev. | 0 | 0.1 | 0 |
| Comp. | 11 | 0.2 | 0.5 | 5 |
| Example 1 | 35 | 0.2 | 0.7 | 1 |
| | 45 | 0.15 | 0.15 | 1 |
| | Average | 0.183 | 0.45 | 2.333 |
| | Std. Dev. | 0.29 | 0.278 | 2.309 |
| Comp. | 11 | 0.1 | 5 | 3 |
| Example 2. | 35 | 0.1 | 2.5 | 3 |
| | 45 | 0.12 | 2.5 | 3 |
| | Average | 0.107 | 3.333 | 3 |
| | Std. Dev. | 0.012 | 1.443 | 0 |

Figure 4:
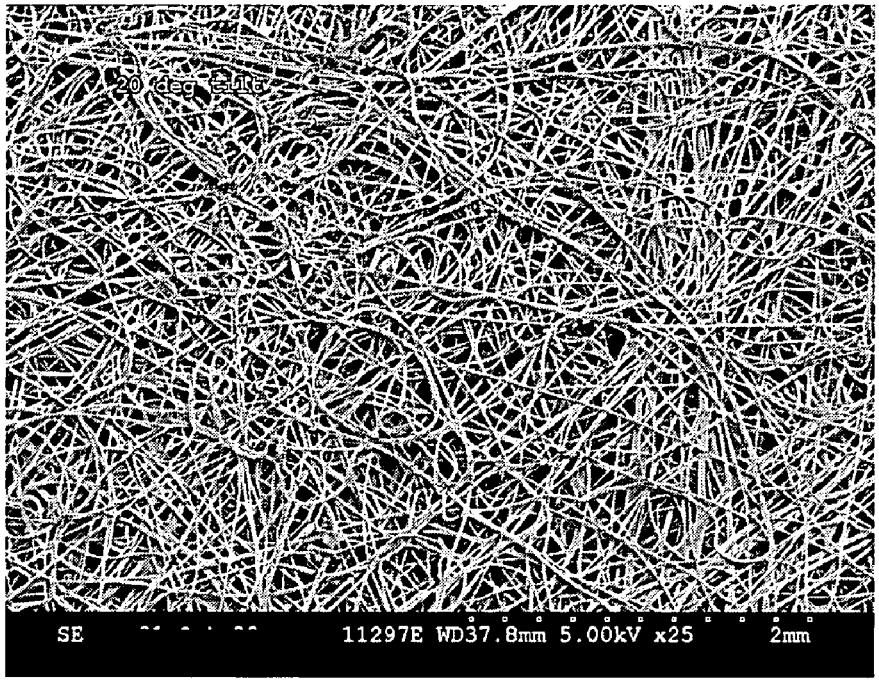
FIG. 4 is a micrograph of the abraided surface of the nonwoven of the present invention.

As can be seen in Table 1, the surface of the nonwoven web with the spunbond layer removed is more abrasion resistant than the comparative Examples where the Spunbond layer was left in place or not used to prepare the nonwoven web. The micrograph of FIG. 4 shows the abraded surface of the nonwoven of Example 1. The micrograph of FIG. 5 shows the abraded surface of the nonwoven of Comparative Example 1. As can be clearly seen, the fibers of Example 1 are abraded but remain in contact with the remainder of the fibers of the nonwoven web. However, in FIG. 2, the fibers are loose and are away from the nonwoven web.

The nonwoven web produced in accordance with the Example of the present invention was compared to the nonwoven of Comparative Example 2 for surface fuzziness. Each nonwoven was tested in accordance on the "Fuzz-on-Edge" test described above. The results are shown in Tables 2 and 3. Table 2 shows the histogram and average values for the Example of the present invention, while Table 3 shows the histogram and average values for Comparative Example 2.

TABLE 1

| | SAMPLE # | AVERAGE PR/EL mm/mm | STD DEV | #FLDS > 2.0 mm/mm | #FLDS > 1.0 mm/mm |
|---|---|---|---|---|---|
| Example 1 | 1 | 0.396 | 0.831 | 1 | 1 |
| | 2 | 0.211 | 0.194 | 0 | 0 |
| Comp. | 1 | 1.469 | 1.00 | 6 | 13 |
| Example 2 | 2 | 2.174 | 1.24 | 13 | 21 |

As can be seen in Table 2, the nonwoven web prepared on the spunbond liner has less free fiber on the surface, as is shown by the average PR/EL value, than the nonwoven prepared directly on the forming wire.

The surface roughness was determined using stylus profilometry test method described above. The results of the test are found in Table 3.

TABLE 3

| FABRIC | Sample | Sa | Sq | Sp | Sv | St | Sz |
|---|---|---|---|---|---|---|---|
| Example 1 | 1 | 22.5 | 28.8 | 111 | 132 | 243 | 211 |
| | 2 | 23.3 | 29.9 | 139 | 166 | 305 | 197 |
| | Avg. | 22.9 | 29.4 | 125 | 149 | 274 | 204 |
| Comp. | 1 | 17.4 | 21.9 | 74.4 | 100 | 174 | 163 |
| Example 2 | 2 | 18.3 | 22.7 | 109 | 105 | 214 | 163 |
| | Avg. | 17.9 | 22.3 | 91.7 | 102.5 | 194 | 163 |

As can be seen in Table 3, the nonwoven web made on the spunbond liner has a rougher surface than the nonwoven web made directly on the forming wire.

While the invention has been described in detail with respect to specific embodiments thereof, and particularly by the example described herein, it will be apparent to those skilled in the art that various alterations, modifications and other changes may be made without departing from the spirit and scope of the present invention. It is therefore intended that all such modifications, alterations and other changes be encompassed by the claims.

We claim:

1. A nonwoven web comprising at least one side which is abrasion resistant, has a surface roughness of at least 20 μm, and a fuzz-on-edge value less than 1.0 mm/mm.

2. The nonwoven web of claim 1, wherein the nonwoven web comprises one or more a spunbond nonwoven web, a meltblown nonwoven web, a bonded carded web, an air-laid nonwoven web or a coform nonwoven web.

3. The nonwoven web of claim 2, wherein the nonwoven web comprises a spunbond nonwoven web.

4. The nonwoven web of claim 1, wherein the nonwoven web comprises monocomponent fibers, multicomponent fibers and/or multiconstituent fibers.

5. The nonwoven web of claim 1, wherein the nonwoven web comprises crimped multicomponent fibers.

6. The nonwoven web of claim 5, wherein the crimped multicomponent fibers comprise spunbond fibers.

7. The nonwoven web of claim 1, wherein the nonwoven web has a density greater than about 0.005 g/cm$^3$ and less than about 0.3 g/cm$^3$.

8. The nonwoven web of claim 1, wherein the fuzz-on-edge is less than 0.6 mm/mm.

9. The nonwoven web of claim 1, wherein the nonwoven web comprises thermoplastic fibers.

10. The nonwoven web of claim 9, wherein the thermoplastic fibers comprise at least one thermoplastic polymer selected from polyolefins, polyesters, polyamides, polycarbonates, polyurethanes, polyvinylchloride, polytetrafluoroethylene, polystyrene, polyethylene terephthalate, polylactic acid and copolymers and blends thereof.

11. The nonwoven web of claim 1, wherein the nonwoven web comprises a bonded web of crimped continuous multicomponent spunbond fibers wherein the nonwoven web has a density greater than about 0.005 g/cm$^3$ and about 0.3 g/cm$^3$.

12. The nonwoven web of claim 11, wherein the fuzz-on-edge is less than 0.5 mm/mm.

13. The nonwoven web of claim 11, wherein the multicomponent fibers comprise polypropylene as one component and a polyethylene as a second component.

14. A laminate comprising a first nonwoven web and a second nonwoven web, wherein the first nonwoven web comprises two sides wherein a first side is abrasion resistant, has a surface roughness of at least 20 μm, and a fuzz-on-edge less than 1.0 mm/mm and a second side which is adjacent to the second nonwoven web.

15. The laminate of claim 14, wherein the first nonwoven web has a density which is greater that the second nonwoven web.

16. The laminate of claim 15, wherein the first nonwoven web has a density between about 0.05 g/cm$^3$ to about 0.30 g/cm$^3$ and the second nonwoven web has a density between about 0.005 g/cm$^3$ and about 0.1 g/cm$^3$.

17. The laminate of claim 14, wherein the first and second nonwoven webs each independently comprise a spunbond nonwoven web, a meltblown nonwoven web, a bonded carded web, an air-laid nonwoven web or a coform nonwoven web.

18. The laminate of claim 14, wherein the first and second nonwoven webs comprise a spunbond nonwoven web.

19. The laminate of claim 14, wherein the first and second nonwoven webs each independently comprise comprises monocomponent fibers, multicomponent fibers and/or multiconstituent fibers.

20. The laminate of claim 19, wherein the spunbond fibers comprise crimped multicomponent fibers spunbond fibers.

21. The laminate of claim 14, wherein the fuzz-on-edge of the first nonwoven web is less than 0.5 mm/mm.

22. The laminate of claim 17, wherein the first and second nonwoven webs each comprise of thermoplastic fibers wherein the thermoplastic fibers comprises at least one thermoplastic polymer selected from polyolefins, polyesters, polyamides, polycarbonates, polyurethanes, polyvinylchloride, polytetrafluoroethylene, polystyrene, polyethylene terephthalate, polylactic acid and copolymers and blends thereof.

23. The laminate of claim 17, wherein the first and second nonwoven webs each independently comprises a bonded web comprising crimped continuous multicomponent spunbond fibers wherein the first nonwoven web has a density greater than the second nonwoven web and the density of the first nonwoven web is between about 0.05 g/cm$^3$ to about 0.30 g/cm$^3$ and the second nonwoven web has a density between about 0.005 g/cm$^3$ and about 0.1 g/cm$^3$.

24. The laminate of claim 23, wherein the multicomponent fibers comprise polypropylene as one component and a polyethylene as a second component.

25. A filter media comprising the nonwoven web of claim 1.

26. A filter media comprising the laminate of claim 14.

* * * * *